US006078297A

United States Patent [19]

Kormanyos

[11] Patent Number: 6,078,297

[45] Date of Patent: Jun. 20, 2000

[54] COMPACT DUAL CIRCULARLY POLARIZED WAVEGUIDE RADIATING ELEMENT

[75] Inventor: Brian K. Kormanyos, Kent, Wash.

[73] Assignee: The Boeing Company, Seattle, Wash.

[21] Appl. No.: 09/047,861

[22] Filed: Mar. 25, 1998

[51] Int. Cl.[7] ..... H01Q 13/00

[52] U.S. Cl. ..... 343/786; 343/772; 343/756

[58] Field of Search ..... 343/786, 756, 343/772, 789, 784; H01Q 13/00

[56] References Cited

U.S. PATENT DOCUMENTS

| | | | |
|---|---|---|---|
| 3,718,935 | 2/1973 | Ranghelli et al. . | |
| 4,707,702 | 11/1987 | Withers . | |
| 4,758,841 | 7/1988 | Grim | 343/786 |
| 4,760,403 | 7/1988 | Grim | 343/786 |
| 4,866,451 | 9/1989 | Chen . | |
| 5,001,444 | 3/1991 | Salvan et al. | 343/786 |
| 5,043,683 | 8/1991 | Howard . | |
| 5,055,852 | 10/1991 | Dusseux et al. | 343/786 |
| 5,412,394 | 5/1995 | Milroy . | |
| 5,583,524 | 12/1996 | Milroy . | |

OTHER PUBLICATIONS

E.C. DuFort, "Finite Scattering Matrix for an Infinite Antenna Array," *Radio Science*, vol. 2, No. 1, pp. 19–27, (Jan. 1967).

G.V. Borgiotti, "Modal Analysis of Periodic Planar Phased Arrays of Apertures," *Proceedings of the IEEE*, vol. 56, No. 11, pp. 1881–1892, (Nov. 1968).

A.G. Ehlenberger et al., "Design Criteria for Linearly Polarized Waveguide Arrays," *Proceedings of the the IEEE*, vol. 56, No. 11, pp. 1861–1972, (Nov. 1968).

R.F. Harrington, *Time–Harmonic Electromagnetic Fields*, McGraw–Hill Classic Textbook Reissue, pp. 204–208, (1961, reissued 1987).

J. Uher et al., *Waveguide Components for Antenna Feed Systems: Theory and CAD*, pp. 419–445, (Artech House, publication date unknown).

*Primary Examiner*—Hoanganh Le

*Attorney, Agent, or Firm*—Christensen O'Connor Johnson & Kindness PLLC

[57] ABSTRACT

A simple continuous metal pattern in a single plane is suspended in a waveguide filled with dielectric material. Two conductive pins penetrate the backshort of the waveguide in an axial direction and are connected at corresponding locations at opposite sides of the metal pattern. The metal pattern forms a radiating element in the shape of a continuous ring, having two convex (with reference to the central axis of the waveguide) primary antenna segments, each of which has one end joined to the corresponding end of the other segment by a narrow bridge segment. The opposite ends of the primary antenna segments extend generally away from each other and are joined by a narrow feedback segment. Within a desired frequency range of operation, the continuous metal pattern is excitable to produce both dominant orthogonal modes of circular polarization with the 90 degree phase difference and in both RHCP and LHCP orientation. More specifically, a modulated electrical signal supplied at one pin results in propagation of an RHCP signal from the waveguide, whereas a modulated electrical signal applied at the other pin results in propagation of an LHCP signal from the waveguide.

40 Claims, 6 Drawing Sheets

COMPACT DUAL CIRCULARLY POLARIZED WAVEGUIDE RADIATING ELEMENT

FIELD OF THE INVENTION

The present invention relates to radiating elements for antennas, particularly phased array antennas having a large number of individually excited antenna elements disposed close together, and more particularly waveguide phased array antennas capable of transmitting and receiving both right hand circularly polarized signals and left hand circularly polarized signals.

BACKGROUND OF THE INVENTION

Phased array antennas are composed of a large number of individual radiating elements that are separately exited. When circular polarization is used, it is desirable to increase the capacity of the system by providing two separate and isolated antenna beams, one with left hand circular polarization (LHCP) and the other with right hand circular polarization (RHCP). Since much of the basic research in the area of phased array antennas has been done with waveguides, this type of element becomes desirable to simplify the design of radomes or matching layers which can optimize axial ratio and control element impedance variation as the array is steered across its scan angle range. Waveguide elements can also be preferred because they provide wider frequency bandwidth and better isolation between elements than dipole or patch antennas, for example.

In a phased array antenna, each radiating element converts the RHCP and LHCP waves into the respective linearly polarized orthogonal modes which, in general, are perpendicular to each other and of approximately equal power. In addition, the dominant modes are processed so as to have a 90° phase difference in time. One approach to such processing is to provide two probes with perpendicular alignment to each other in space, and a quadrature hybrid coupler external to the waveguide to provide the 90° phase difference. For example, Howard U.S. Pat. No. 5,043,683, shows two probes in the form of linear antenna segments projecting inward from the side of a circular waveguide at an angle of 90° relative to each other. A quadrature hybrid coupler external to the waveguide (see, for example, FIG. 2 of U.S. Pat. No. 5,043,683) processes the signals from the respective probes to achieve the desired 90° phase difference.

A second approach is to use two mutually perpendicular probes and a differential phase delay polarizer internal to the waveguide. The polarizer is oriented at 45° to both of the probes. A similar approach is used in the construction of Withers U.S. Pat. No. 4,707,702, where a single probe projects radially through the side of a circular waveguide containing a polarizer inclined at an angle of 45° to the probe and located specifically to result in two orthogonal waves, one delayed by 90° more than the other.

Problems with the known approaches include: precise positioning is required for multiple components; bulky elements may be required external to the waveguides; elements project from the sides of the waveguides and thereby affect the close packing required for an efficient phased array antenna; as well as impedance matching and isolation characteristics.

SUMMARY OF THE INVENTION

The present invention provides a radiating element located internally of a waveguide and effective for dual (RHCP and LHCP) circularly polarized signals, of small size, light weight, and low cost for use particularly in phased array antennas. In the preferred embodiment, the radiating element consists of a simple continuous metal pattern in a single plane suspended in a waveguide filled with dielectric material. Two conductive pins penetrate the back short of the waveguide in an axial direction, as compared to pins or probes extending radially into a waveguide, to excite the radiating element or be excited by it. Within a desired frequency range of operation, the single continuous metal pattern is excitable to produce both dominant orthogonal modes of circular polarization with the desired 90° phase difference and in both RHCP and LHCP orientation, with no bulky, complicated, or expensive external elements. While the shape of the continuous radiating element is crucial to its performance, once formed its positioning is relatively easy within the circular waveguide, so long as the distance between the radiating element and the back short end of the waveguide is carefully maintained to assure a good impedance match.

In the preferred embodiment, the radiating element has two convex (with reference to the central axis of the waveguide) primary antenna segments, each of which has a wider, generally radially inward-extending end joined to the corresponding end of the other such segment by a narrow bridging section. Each of the arcuate segments curves away from the other through an angle of about 90° and tapers in width from the end connected to the bridge. Thus, the ends of such segments remote from the joined ends extend generally oppositely, but at the same side of a transverse diameter as the joined ends, terminating at locations close to opposite sides of the circular waveguide. From such ends, a concave, almost semicircular, thin "feedback" segment of the radiating element extends close to the inner periphery of the waveguide wall so as to join the thinner, oppositely directed ends of the primary radiating segments. At corresponding locations along the feedback segment, the conductive pins by which the radiating element is excited, or by means of which the signal exciting the element is conveyed, extend rearward through the back short end of the waveguide.

In operation, excitation of the radiating element by a signal applied at one of the conductive pins is conveyed to the continuous metal antenna ring. The arcuate antenna segments result in projecting the dominant orthogonal modes of circular polarization with the desired 90° phase difference. Part of the signal reaches the other pin by way of the arcuate antenna segments, and part of the signal reaches the other pin by way of the feedback segment. These two parts are of approximately equal power and 180° out of phase with each other, so as to effectively cancel each other at the other pin.

Similarly, a signal applied at the other pin excites the antenna ring, and the arcuate antenna segments result in projection of the dominant orthogonal modes with a 90° phase difference. However, for a signal applied at one pin, the 90° phase difference is lagging, whereas for the signal applied at the other pin the 90° phase difference is leading. For a signal applied at the second pin, the same cancellation applies at the first pin, as described above.

Similarly, an incoming circularly polarized signal of one sense (LHCP or RHCP) will excite one pin depending on whether the phase difference of the dominant orthogonal modes is leading or lagging, whereas an incoming signal of the other sense will excite the other pin. The result is a very compact waveguide radiating element, excited from the rear rather than from the side, making it particularly adapted for use in phased array antennas.

BRIEF DESCRIPTION OF THE DRAWINGS

The foregoing aspects and many of the attendant advantages of this invention will become more readily appreciated as the sarne becomes better understood by reference to the following detailed description, when taken in conjunction with the accompanying drawings, wherein.

DETAILED DESCRIPTION OF THE PREFERRED EMBODIMENT

Figure 1:
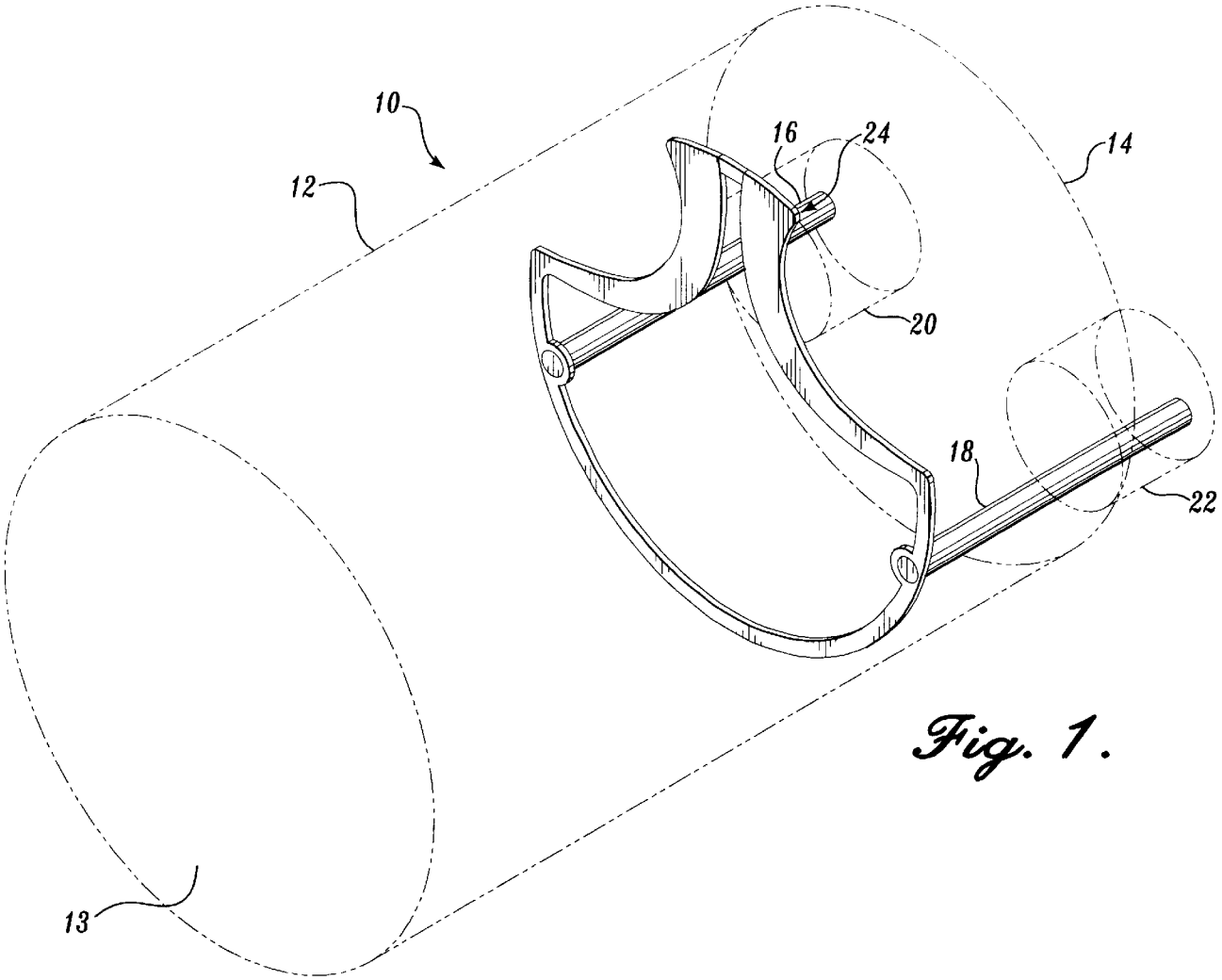
FIG. 1 is a perspective of a compact dual circularly polarized waveguide radiating element in accordance with the present invention.

The compact dual circularly polarized (LHCP and RHCP) waveguide radiating element in accordance with the present invention is particularly useful for close packing in a phased array antenna where it is desirable that a large number of individually excited antenna elements be disposed close together. It also is desirable for such a phased array antenna to have a low profile, as compared to known assemblies requiring a large number of external components stacked one on top of the other and thereby increasing the weight, complexity, cost and thickness of the composite phased array antenna.

The preferred embodiment of the present invention shown in the drawings and described in detail below was designed and tested by extensive full wave electromagnetic simulation of the three dimensional structure using the commercial software package sold under the trademark "Ansoft Maxwell Eminence". Specifically, the element was designed to operate in the 19.5 to 20.5 GHz range, with a good match to a standard 50 Ohm impedance. To achieve the design goals, approximately one-half of the power input at either of two ports (ports 1 and 2) must be transferred to a third port (port 3) in transverse electric mode 1, and the remaining half of the input power must be transferred to port 3 in transverse electric mode 2. Using standard terminology, the signal transferred at port 1 to port 3 in transverse electric mode 1 is represented as S3_1,1_1, and the signal transferred in transverse electric mode 1 from port 2 to port 3 is represented as S3_1,2_1. The transfer from port 1 to port 3 in transverse electric mode 2 (the other dominant orthogonal mode) is represented as S3_2,1_1, and the transfer in transverse electric mode 2 from port 2 to port 3 is represented as S3_2,2_1. Depending on the sense or "handedness" of the circular polarization, there should be as close as possible to a 90 degree phase lead or lag between transverse electric mode 1 and transverse electric mode 2. Further, transfer between port 1 and port 2 (S2_1,1_1 and S1_1,2_1) is minimized for good isolation (at least about 15 db in operating range of 19.5 to 20.5 GHz in the preferred embodiment). Further, the reflected input power (S1_1,1_1 and S2_1,2_1) must be quite low, illustrating a good impedance match. 50 Ohms is a standard impedance for matching. The bandwidth of the radiating element can be quite large depending on how much deviation form ideal circular polarization can be tolerated. Dimensions of the waveguide radiating element in accordance with the present invention are based on these predetermined design characteristics. It should be understood that the preferred dimensions could be modified for achieving other operating characteristics, such as an impedance match to other than 50 Ohms or an operating range of other than 19.5 to 20.5 GHz, for example.

Referring now to FIG. 1, the compact dual circularly polarized waveguide radiating element 10 in accordance with the present invention has a cylindrical waveguide 12 of conductive material open at one end 13 (the "output end") and closed at the other end (the "backshort end") 14. The waveguide wall is shown as transparent for ease of explanation. A first conductive probe 16 and a second conductive probe 18 extend into the waveguide through the backshort end 14, through short cylindrical conductive stems 20 and 22, respectively. Each stem forms an opening into the backshort end.

The inner ends of the two probes are connected to an antenna element 24 of complex shape. In general, the antenna element is a thin (2 mils in the preferred embodiment) trace or pattern of conductive material formed in the shape of a continuous ring which is open at the center. The ring preferably is a printed metal pattern and lies within a single plane. For stability, the waveguide can be filled with dielectric material which, for modeling purposes, is presumed to have a relative dielectric constant of 3.0. The dielectric can be injection molded in a single piece with the metal pattern and pins carefully maintained in the necessary positions, or the metal pattern (ring) can be formed on a face of a cylindrical plug of the dielectric which then can be inserted into the waveguide into engagement with the backshort, followed by filling the remainder of the waveguide with the dielectric. The antenna can work without dielectric or with dielectrics of different relative constants, but this will change the input impedance to a real value other than 50 Ohms and require the dimensions to be scaled for proper operation within the same desired frequency range.

Figure 2:
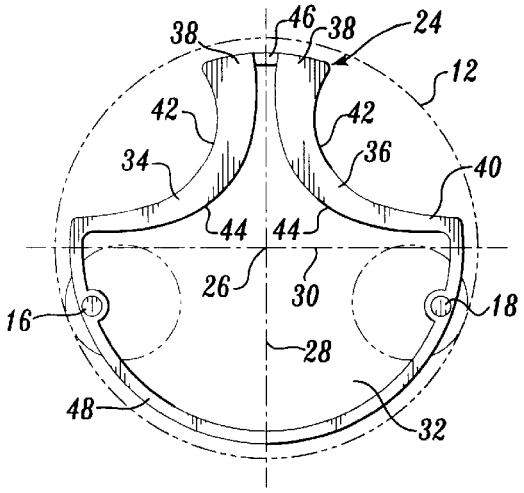
FIG. 2 is an end elevation of the waveguide radiating element of FIG. 1.

The general shape of the antenna ring 24 is shown in FIG. 2 and can be described with reference to the center 26 of the cylindrical waveguide 12 and two mutually perpendicular diameters, namely, an upright diameter 28 and a horizontal diameter 30. These diameters divide the cross-sectional plane containing the antenna ring into four quadrants The antenna 24 is a continuous ring encircling the center 26 of the waveguide and defining an open area 32 encompassing the major portion of the waveguide cross section. The ring is symmetrical about the upright diameter 28. The ring is composed of two primary radiating, generally arcuate segments 34 and 36. Using the center 26 as a reference, each segment 34, 36 is sharply convex and fits wholly within an upper quadrant. An upper end 38 of each segment 34, 36 extends from a location close to the top of the waveguide 12, generally radially inward, and curves downward and outward through an angle of approximately 90° to a bottom end 40 closely adjacent to a sidewall of the waveguide. The radius of curvature is less than the radius of the waveguide, and sharper for the outer edge 42 of the segment than for the inner edge 44. The result is that each segment 34, 36 tapers in width from its upper end 38 to its lower end 40, with the lower ends of the segments positioned close to the opposite sides of the waveguide but still above the horizontal diameter 30. At the very top of the antenna ring 24, a short and narrow bridging section 46 connects the upper ends of the two segments 34, 36.

From the bottom ends 40 of the segments 34, 36, the antenna ring continues as a narrow "feedback" segment 48 which is of constant width and arcuate (concave) concentric with the adjacent portion of the waveguide wall. Such segment 48 extends all the way from the lower end 40 of one segment 34, 36, through the next lower cross-sectional quadrant, then through the next transversely adjacent quadrant and up to the lower end 40 of the other of the segments 34, 36. The pins or probes 16 and 18 by which the antenna ring is excited, or which are excited by operation of the antenna ring, are connected to the generally semicircular feedback segment 48 at corresponding locations at opposite sides of the antenna ring 24, at positions below the ends 40 of the segments 34, 36, and in the next lower cross-sectional quadrants.

Figure 3:
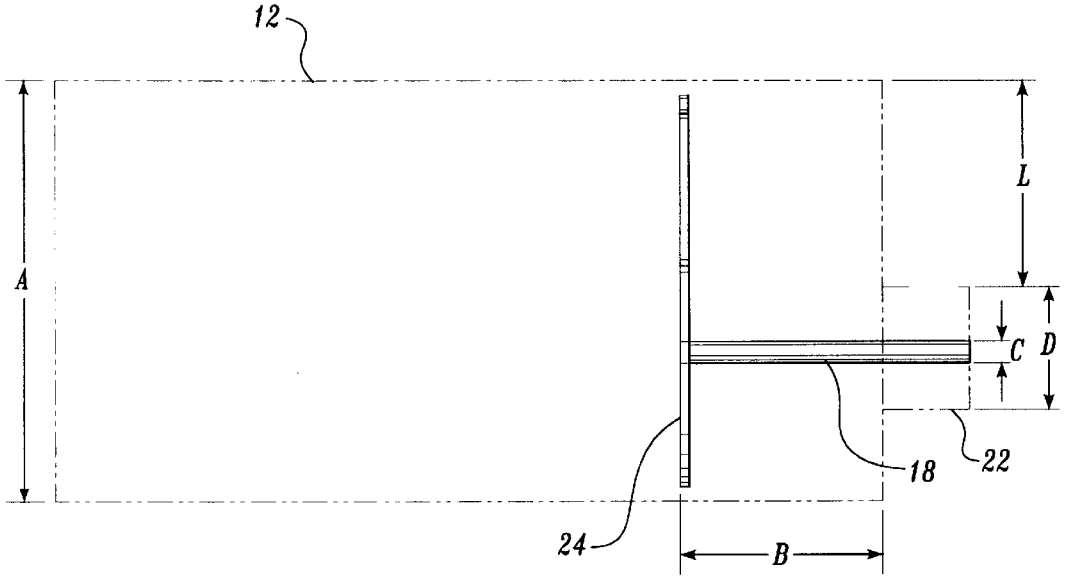
FIG. 3 is a side elevation of the waveguide radiating element of FIGS. 1 and 2.

The operating characteristics of the waveguide radiating element in accordance with the present invention are very dependent on the dimensions and placement of the various components and, as noted above, have been determined by computerized modeling. As often occurs in antenna design, a substantial variation in one dimension may affect another dimension in order to achieve the desired operating characteristics. With reference to FIG. 3, in the preferred embodiment, assuming an interior dielectric with a relative dielectric constant of 3.0, the waveguide 12 has an inner diameter A of 250 mils. The plane of the antenna ring 24 extends perpendicular to the waveguide axis, at a distance B of 117 mils from the backshort end 14. The spacing B from the backshort end of the waveguide affects primarily the impedance match and, in the preferred embodiment, is more than one-quarter wavelength of the preferred operating range (19.5 GHz to 20.5 GHz) for an unbounded wave in a material having a dielectric constant of 3, which would correspond to 87.4 mils to 83.2 mils, but less than the one-quarter wavelength for a wave bounded in a circular waveguide of the type described, which would correspond to 165.0 mils to 140.6 mils.

The diameter C of each of the pins or probes 16, 18 is 12.73 mils, and the inner diameter D of each of the stems 22, 24 is 68.03 mils, with the top edge of each stem spaced a distance L below the top of the waveguide equal to 121.58 mils, slightly less than the radius of the waveguide which is 125 mils.

Figure 4:
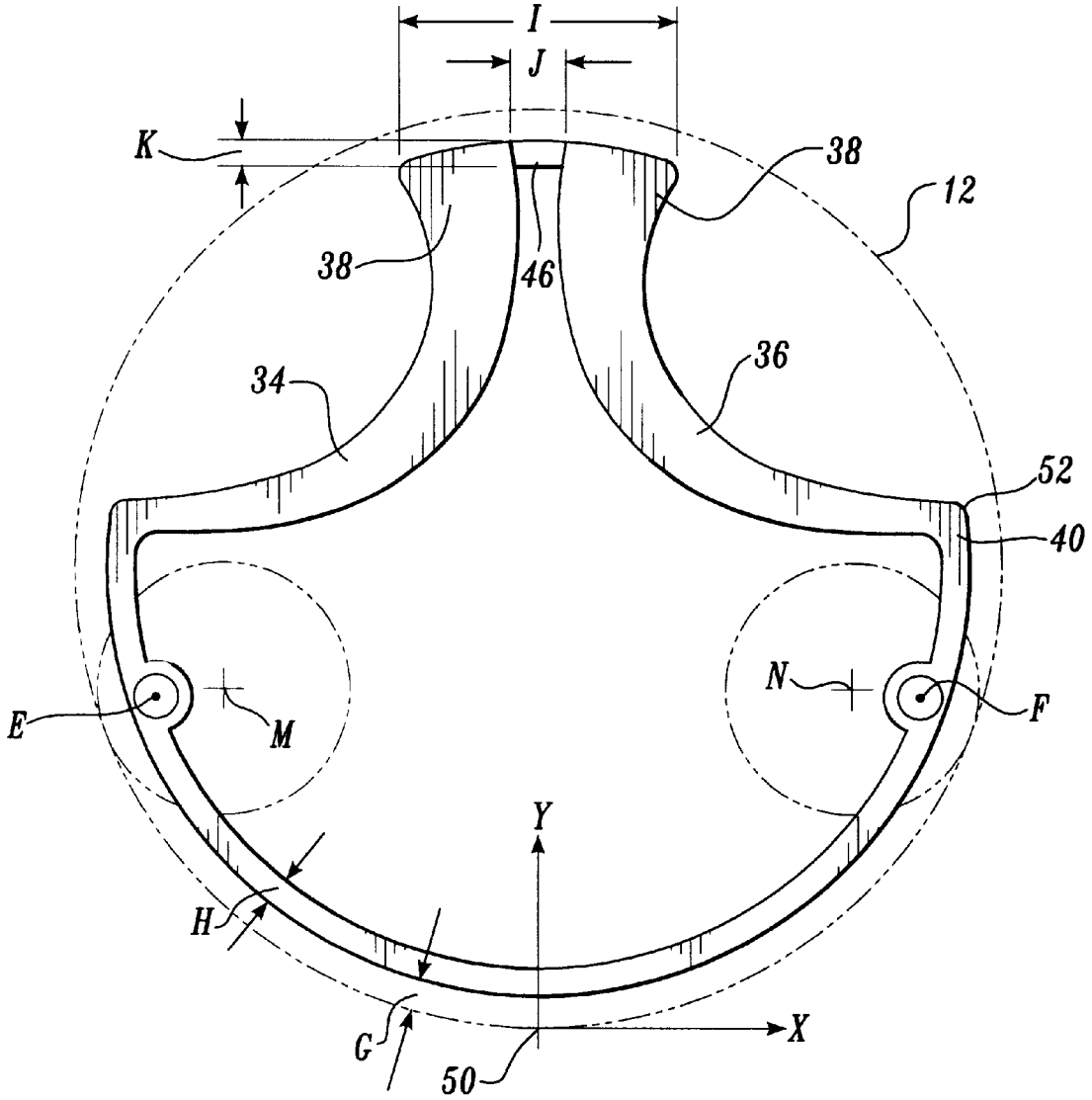
FIG. 4 is an enlarged end elevation of the waveguide radiating element of FIGS. 1–3.

Additional dimensions are best described with reference to the enlarged end elevation of FIG. 4. If the bottom point 50 of the interior wall of the waveguide 12 is used as the 0,0 reference point for a two dimensional cartesian coordinate system XY, the center point E of pin 16 is located at −99.52, 89.03 (mils) and the center point F of the other pin 18 is located at 99.52, 89.03. The centers M and N of the stems 20 and 22 are at −88, 94 and 88, 94 respectively. The upper shoulders 52 of the antenna segments 34, 36 are located at a Y coordinate of 142.44. The spacing G of the outer periphery of the feedback segment 48 from the inner periphery of the waveguide wall is 8.00 mils, and the width H of such segment is 7.00 mils. At the upper ends 38 of the segments 34, 36, the distance I between the outer edges of the adjacent ends of the segments is 78.43 mils, and the distance J between the inner edges of such upper ends is 12.63 mils (which also is the length of the bridge section 46). The width K of the bridge section is 7 mils. The tapering of the segments 34, 36 is such that at their outer ends 40 they are approximately of the same upright width as the transverse width of the feedback segment 48, namely, 7.00 mils.

Figure 5:
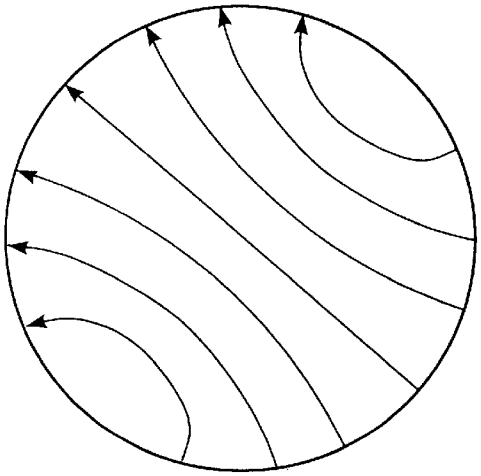
FIG. 5 and FIG. 6 are diagrammatic views illustrating the electric field vector distributions for the two dominant (lowest order) orthogonal propagating modes in a circular waveguide.
Figure 6:
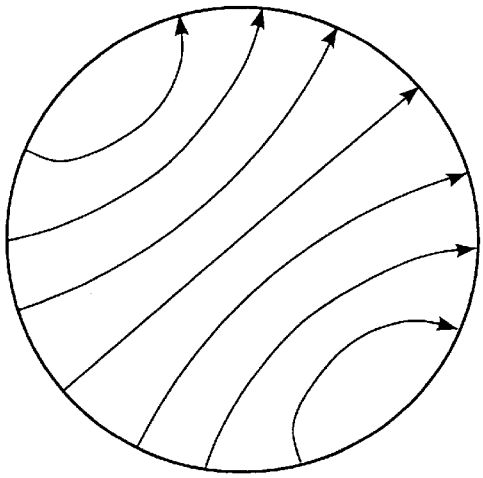

Operation of the waveguide radiating element in accordance with the present invention is best described with reference to FIGS. 5–9. FIGS. 5 and 6 illustrate cross-sectional views of the electric field vector distributions for the two lowest order orthogonal propagating modes in a circular waveguide. Since the waveguide is circular, these two modes may be defined at any angle, so long as they are perpendicular to each other. Circular polarization will exist when each of the two modes are excited equally by time harmonic signals with a 90 degree phase difference between the signals. The result of this excitation is an overall electric field vector that is of constant magnitude while its orientation is observed to rotate through a complete circle with each time harmonic cycle. The direction of rotation may be toward the right hand or left hand depending the sign (+or −) of the 90 degree phase difference.

Figure 7:
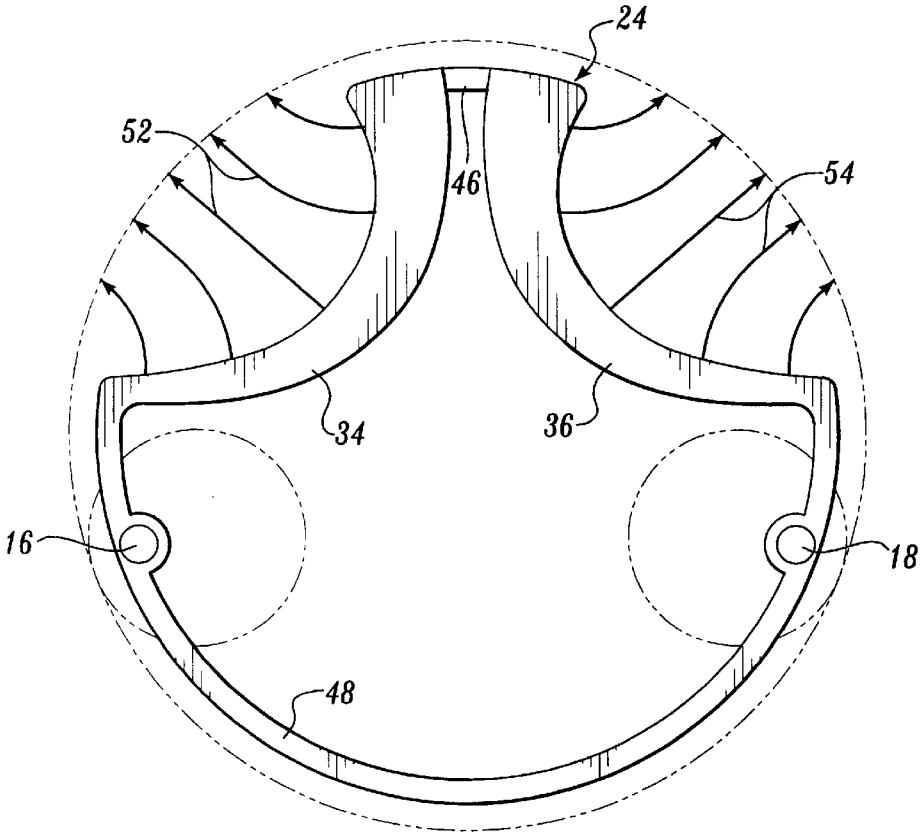
FIG. 7 is an end elevation of the waveguide radiating element in accordance with the present invention illustrating diagrammatically a portion of the electric field vector distributions for the two dominant orthogonal propagating modes of a circularly polarized signal within the waveguide.

As seen in FIG. 7, as applied to the antenna ring 24, one orthogonal mode is represented by the arrows 52 and the other orthogonal mode is represented by arrows 54. A signal starting at one of the pins 16, 18 travels up the pin and results in a part that goes directly to the upper radiating segments 34 and 36 and a part that goes along the feedback line 48. The arrangement of the upper mode segments connected by the bridging section 46 results in one orthogonal mode being created as represented by the arrows 52 and the other orthogonal mode being created as represented by the arrows 54. The distance of travel and arrangement of the two mode segments 34 and 36 produces the desired 90 degree phase difference between the two modes. For a signal originating at pin 16, any part of the signal reaching the other pin 18 by way of segment 36 is combined with the part of the signal that travels directly along the feedback segment to produce a null at pin 18, i.e., any signal fed to pin 18 by way of segment 36 which originated by exciting pin 16 is of equal magnitude and 180 degrees out of phase relative to the part of the signal carried by the feedback segment 48.

The same factors apply with respect to a signal exciting pin 18, which excites the upper radiating segments 34 and 36 to produce the orthogonal modes with the 90 degree phase difference, but in this case in the opposite sense as compared to a signal exciting pin 16. Nevertheless, the portion of the signal from pin 18 which passes to pin 16 by way of the radiating segments 34 and 36 and the upper bridge section 46 is canceled (equal amplitude but 180 degrees out of phase) by the part of the signal from pin 18 traveling along the lower part of the feedback segment 48. Thus, one pin can be excited to produce a left-handed circularly polarized signal whereas the other pin can be used to produce a right-handed circularly polarized signal. Similarly, an incoming circularly polarized signal of one sense (LHCP or RHCP) will excite one pin whereas an incoming signal of the other sense will excite the other pin.

Figure 8:
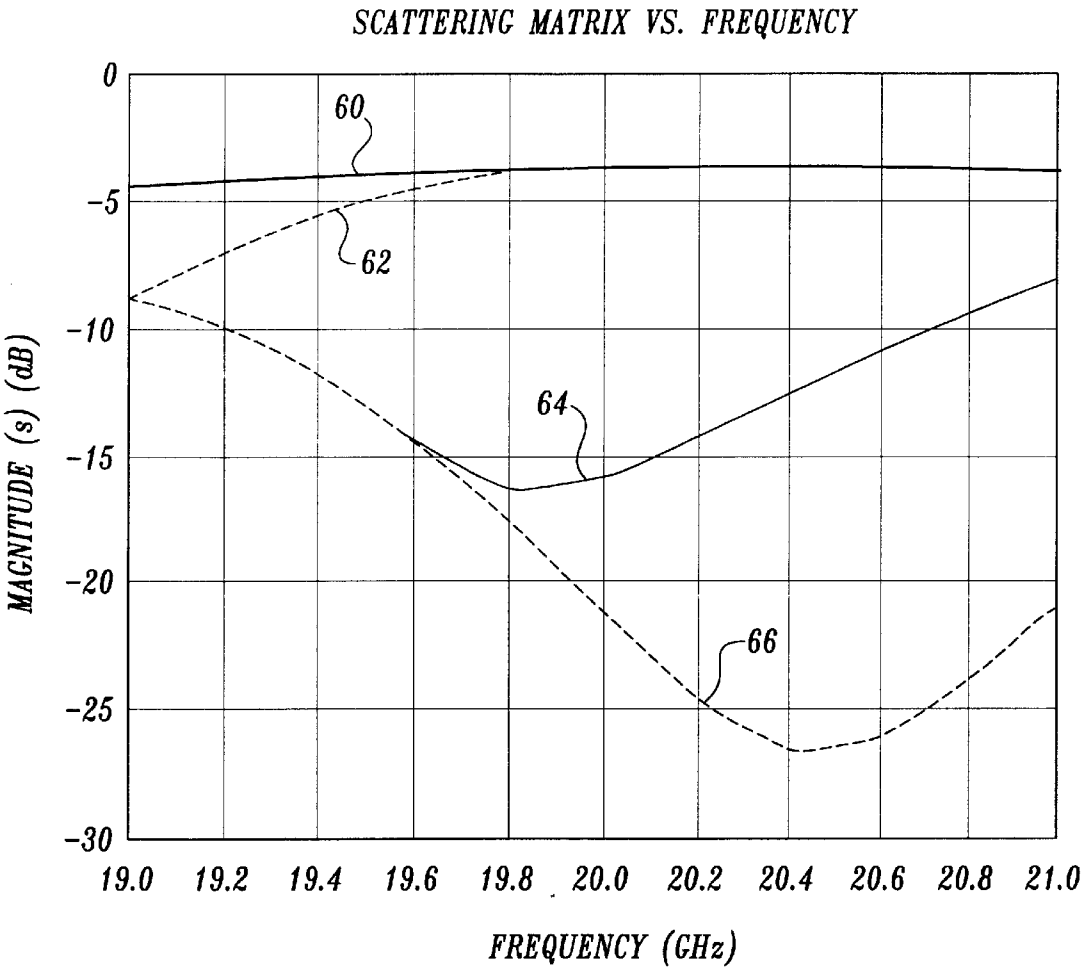
FIGS. 8 and 9 are a graphs illustrating operating characteristics of a preferred embodiment of the present invention.
Figure 9:
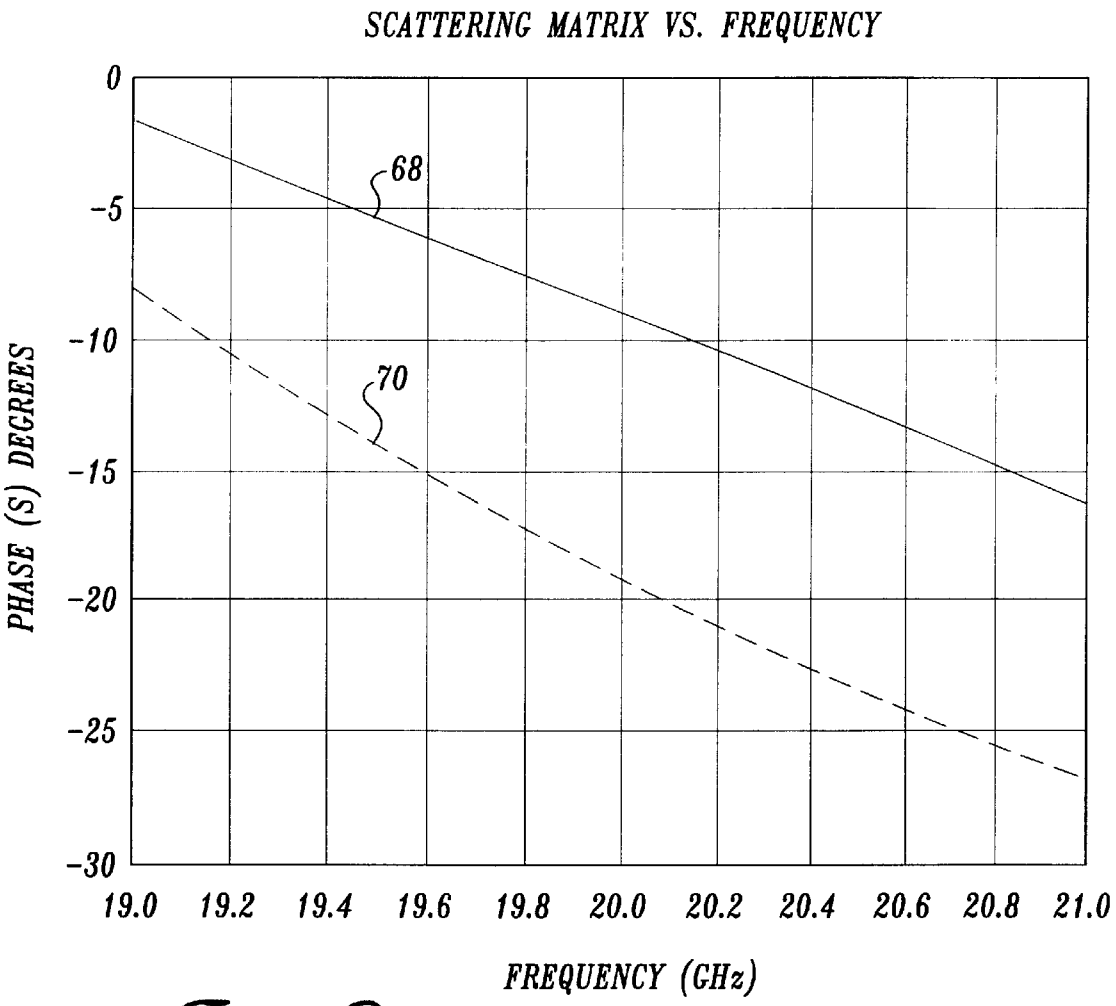

The extent to which the illustrated embodiment accurately achieves its intended purpose is represented in FIGS. 8 and 9, showing the results of three dimensional fullwave electromagnetic simulation. Line 60 in FIG. 8 represents S3_1, 1_1, which is the power transferred from port 1 (pin 16) mode 1 to port 3 (the open end of the waveguide) in mode 1. Line 62 represents S3_2,1_1, which is the power transferred from port 1 (pin 18) mode 1 to port 3 in transverse electric mode 2. It will be seen that for frequencies above about 19.5 GHz there is an equal power split between the two orthogonal modes at port 3.

Line 64 illustrates reflected power at port 1 (S1_1,1_1) which in the preferred operating frequency range of 19.5 GHz to 20.5 GHz is low (at least about 15 db below the power transferred to port 3) illustrating the good impedance match. Line 66 represents the power transfer ratio from port 1 to port 2 in transverse electric mode 1 (S2_1,1_1) which is very low for frequencies in and above the design frequency range, illustrating good isolation between the two input ports 1 and 2 which correspond to pins 16 and 18.

The final parameter is the phase difference of the orthogonal modes, which is illustrated in FIG. 9. Line 68 represents S3_1,1_1, and line 70 represents S3_2,1_1, with the phase difference corresponding to the vertical distance between the lines. Within the design frequency range, the phase difference between the dominant orthogonal modes is nearly 90 degrees, although there is some variation depending on the frequency.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An antenna element comprising:

a waveguide having a longitudinal axis, an output end and a backshort end opposite the output end;

a planar continuous antenna ring suspended in the waveguide with the plane of the ring extending transversely thereof, the antenna ring being open at the center and having a first elongated primary antenna segment having first and second ends, a second elongated primary antenna segment having first and second ends, a bridge segment extending between the first and second primary antenna segments, and a feedback segment joining the first and second primary antenna segments, the primary antenna segments tapering in width from the first ends thereof to the second ends thereof; and first and second signal excitation pins joined to the continuous antenna ring at generally opposite sides thereof for conveying signals to and from the planar continuous antenna ring.

2. The antenna element defined in claim 1, in which the waveguide, planar continuous antenna ring, and first and second signal excitation pins are constructed and arranged relatively such that for a signal having a frequency within a range of interest exciting one of the pins results in transmission of a circularly polarized signal of one sense from the waveguide whereas excitation of the other pin results in transmission of a circularly polarized signal of the other sense from the waveguide.

3. The antenna element defined in claim 1, in which the bridge segment extends between the first ends of the primary antenna segments, and the feedback segment joins the second ends of the primary antenna segments.

4. The antenna element defined in claim 1, in which the excitation pins extend through the backshort end of the waveguide to the continuous antenna ring.

5. The antenna element defined in claim 1, in which the antenna ring is contoured to excite orthogonal modes of circular polarization with approximately 90 degree phase difference by application of a signal to one of the excitation pins.

6. The antenna element defined in claim 1, in which the first primary antenna segment is located wholly within one quadrant of the waveguide cross section, and the second primary antenna segment is located wholly within a second quadrant of the waveguide cross section adjacent to the first quadrant.

7. The antenna element defined in claim 1, in which the feedback segment extends close to the periphery of the waveguide from the second end of the first primary antenna segment to the second end of the other of the primary antenna segments.

8. The antenna element defined in claim 1, in which the planar continuous antenna ring is suspended in the waveguide at a location spaced from the backshort end between one-quarter wavelength for an unbounded wave having a frequency within a frequency range of interest and one-quarter wavelength of a wave bounded in the waveguide having a frequency within the frequency range of interest.

9. The antenna element defined in claim 8, in which the frequency range of interest is approximately centered about 20 MHz.

10. The antenna element defined in claim 1, in which the waveguide, continuous antenna ring and signal excitation pins are contoured, constructed and arranged relatively such that a modulated electrical signal having a frequency within a predetermined range of interest applied at the first signal excitation pin results in propagation of a left-handed circularly polarized wave from the output end of the waveguide and a modulated electrical signal having a frequency within the predetermined range of interest applied at the second pin results in propagation of a right-handed circularly polarized signal from the output end of the waveguide.

11. The antenna element defined in claim 1, in which the waveguide is of circular cross section, the feedback segment being approximately semi-circular and disposed close to the inner periphery of the waveguide throughout the length of the feedback segment.

12. The antenna element defined in claim 11, which the signal excitation pins are joined to the feedback segment of the continuous antenna ring at corresponding locations spaced from the second ends of the primary antenna segments.

13. The antenna element defined in claim 11, in which the signal excitation pins are joined to the feedback segment at corresponding locations at opposite sides thereof and are located at the same side of a transverse diameter of the waveguide.

14. An antenna element comprising:

a waveguide having a longitudinal axis, an output end and a backshort end opposite the output end;

a planar continuous antenna ring suspended in the waveguide with the plane of the ring extending transversely thereof, the antenna ring being open at the center and the open area of the antenna ring encompassing the major portion of the waveguide cross section, the antenna ring having a first elongated primary antenna segment having first and second ends, a second elongated primary antenna segment having first and second ends, each of said first and second primary antenna segments being convex with reference to the center of the waveguide and being wholly located within a quadrant of the waveguide cross section and each of the first and second primary antenna segments tapering in width from the first end to the second end thereof, the antenna ring including a bridge segment extending between the first ends of the first and second primary antenna segments and of a width much less than the width of either of the first ends of the primary antenna segments, each of the primary antenna segments curving through an angle of approximately 90° from its first end to its second end and the second ends of the primary antenna segments being located close to opposite sides of the waveguide, the antenna ring further including a narrow feedback segment extending close to the periphery of the waveguide from the second end of the first primary antenna segment to the second end of the other of the primary antenna segments; and first and second signal excitation pins extending through the backshort end of the waveguide and joined to the continuous antenna ring at generally opposite sides thereof for conveying signals to and from the antenna ring, the waveguide, antenna ring and first and second signal excitation pins being constructed and arranged relatively for transmission and reception of a left-handed circularly polarized wave at the first excitation pin and a right-handed circularly polarized wave at the second excitation pin when the transmission frequency is within a predetermined frequency range of interest.

15. An antenna element comprising:

a waveguide having a longitudinal axis, an output end and a backshort end opposite the output end;

a planar continuous antenna ring suspended in the waveguide with the plane of the ring extending transversely thereof, the antenna ring being open at the center and having a first elongated primary antenna segment having first and second ends, a second elongated primary antenna segment having first and second ends, a bridge segment extending between the first and second primary antenna segments, and a feedback segment joining the first and second primary antenna segments, the bridge segment having a width much less than the width of either of the primary antenna segments; and first and second signal excitation pins joined to the continuous antenna ring at generally opposite sides thereof for conveying signals to and from the planar continuous antenna ring.

16. The antenna element defined in claim 15, in which the waveguide, planar continuous antenna ring, and first and second signal excitation pins are constructed and arranged relatively such that for a signal having a frequency within a range of interest exciting one of the pins results in transmission of a circularly polarized signal of one sense from the waveguide whereas excitation of the other pin results in transmission of a circularly polarized signal of the other sense from the waveguide.

17. The antenna element defined in claim 15, in which the bridge segment extends between the first ends of the primary antenna segments, and the feedback segment joins the second ends of the primary antenna segments.

18. The antenna element defined in claim 15, in which the antenna ring is contoured to excite orthogonal modes of circular polarization with approximately 90 degree phase difference by application of a signal to one of the excitation pins.

19. The antenna element defined in claim 15, in which the open area at the center of the antenna ring encompasses the major portion of the waveguide cross section.

20. The antenna element defined in claim 15, in which the primary antenna segments are arcuate and convex with reference to the center of the waveguide, the first ends being disposed closely adjacent, and the primary antenna segments curving away from each other in a direction from the first ends toward the second ends.

21. The antenna element defined in claim 15, in which the first primary antenna segment is located wholly within one quadrant of the waveguide cross section, and the second primary antenna segment is located wholly within a second quadrant of the waveguide cross section adjacent to the first quadrant.

22. The antenna element defined in claim 15, in which the planar continuous antenna ring is suspended in the waveguide at a location spaced from the backshort end between one-quarter wavelength for an unbounded wave having a frequency within a frequency range of interest and one-quarter wavelength of a wave bounded in the waveguide having a frequency within the frequency range of interest.

23. The antenna element defined in claim 15, in which the waveguide, continuous antenna ring and signal excitation pins are contoured, constructed and arranged relatively such that a modulated electrical signal having a frequency within a predetermined range of interest applied at the first signal excitation pin results in propagation of a left-handed circularly polarized wave from the output end of the waveguide and a modulated electrical signal having a frequency within the predetermined range of interest applied at the second pin results in propagation of a right-handed circularly polarized signal from the output end of the waveguide.

24. The antenna element defined in claim 15, in which the waveguide is of circular cross section, the feedback segment being approximately semi-circular and disposed close to the inner periphery of the waveguide throughout the length of the feedback segment.

25. The antenna element defined in claim 24, in which the signal excitation pins are joined to the feedback segment at corresponding locations at opposite sides thereof and are located at the same side of a transverse diameter of the waveguide.

26. An antenna element comprising:

a waveguide having a longitudinal axis, an output end and a backshort end opposite the output end;

a planar continuous antenna ring suspended in the waveguide with the plane of the ring extending transversely thereof, the antenna ring being open at the center and having a first elongated primary antenna segment having first and second ends, a second elongated primary antenna segment having first and second ends, a bridge segment extending between the first and second primary antenna segments, and a feedback segment joining the first and second primary antenna segments, the primary antenna segments being arcuate and convex relative to the center of the waveguide; and first and second signal excitation pins joined to the continuous antenna ring at generally opposite sides thereof for conveying signals to and from the planar continuous antenna ring.

27. The antenna element defined in claim 26, in which the waveguide, planar continuous antenna ring, and first and second signal excitation pins are constructed and arranged relatively such that for a signal having a frequency within a range of interest exciting one of the pins results in transmission of a circularly polarized signal of one sense from the waveguide whereas excitation of the other pin results in transmission of a circularly polarized signal of the other sense from the waveguide.

28. The antenna element defined in claim 26, in which the bridge segment extends between the first ends of the primary antenna segments, and the feedback segment joins the second ends of the primary antenna segments.

29. The antenna element defined in claim 26, in which the antenna ring is contoured to excite orthogonal modes of circular polarization with approximately 90 degree phase difference by application of a signal to one of the excitation pins.

30. The antenna element defined in claim 26, in which the open area at the center of the antenna ring encompasses the major portion of the waveguide cross section.

31. The antenna element defined in claim 26, in which the first primary antenna segment is located wholly within one quadrant of the waveguide cross section, and the second primary antenna segment is located wholly within a second quadrant of the waveguide cross section adjacent to the first quadrant.

32. The antenna element defined in claim 26, in which the planar continuous antenna ring is suspended in the waveguide at a location spaced from the backshort end between one-quarter wavelength for an unbounded wave having a frequency within a frequency range of interest and one-quarter wavelength of a wave bounded in the waveguide having a frequency within the frequency range of interest.

33. The antenna element defined in claim 26, in which the waveguide, continuous antenna ring and signal excitation pins are contoured, constructed and arranged relatively such that a modulated electrical signal having a frequency within a predetermined range of interest applied at the first signal excitation pin results in propagation of a left-handed circularly polarized wave from the output end of the waveguide and a modulated electrical signal having a frequency within the predetermined range of interest applied at the second pin results in propagation of a right-handed circularly polarized signal from the output end of the, waveguide.

34. The antenna element defined in claim 26, in which the waveguide is of circular cross section, the feedback segment being approximately semi-circular and disposed close to the inner periphery of the waveguide throughout the length of the feedback segment.

35. The antenna element defined in claim 34, in which the signal excitation pins are joined to the feedback segment at corresponding locations at opposite sides thereof and are located at the same side of a transverse diameter of the waveguide.

36. The antenna element defined in claim 24, in which each of the primary antenna segments curves through an angle of approximately 90 degrees.

37. The antenna element defined in claim 36, in which the second ends of the primary antenna segments are disposed close to opposite sides of the waveguide.

38. An antenna element comprising:

a waveguide having a longitudinal axis, an output end and a backshort end opposite the output end;

a planar continuous antenna ring suspended in the waveguide with the plane of the ring extending transversely thereof, the antenna ring being open at the center and having a first elongated primary antenna segment having first and second ends, a second elongated primary antenna segment having first and second ends, a bridge segment extending between the first and second primary antenna segments, and a feedback segment joining the first and second primary antenna segments, the open area at the center of the antenna ring encompassing the major portion of the waveguide cross section; and first and second signal excitation pins joined to the continuous antenna ring at generally opposite sides thereof for conveying signals to and from the planar continuous antenna ring.

39. The antenna element defined in claim 38 in which the waveguide, planar continuous antenna ring, and first and second signal excitation pins are constructed and arranged relatively such that for a signal having a frequency within a range of interest exciting one of the pins results in transmission of a circularly polarized signal of one sense from the waveguide whereas excitation of the other pin results in transmission of a circularly polarized signal of the other sense from the waveguide.

40. The antenna element defined in claim 38, in which the bridge segment extends between the first ends of the primary antenna segments, and the feedback segment joins the second ends of the primary antenna segments.

* * * * *

UNITED STATES PATENT AND TRADEMARK OFFICE

CERTIFICATE OF CORRECTION

PATENT NO. : 6,078,297
DATED : June 20, 2000
INVENTOR(S) : B.K. Kormanyos

It is certified that error appears in the above-identified patent and that said Letters Patent is hereby corrected as shown below:

Title Page,
Item [56] Under References Cited, Other Publications, delete second instance of "*the*".
Item [56] Under References Cited, Other Publications, "1972" should be -- 1872 --

Column 11,
Line 27, delete "," before "waveguide"
Line 38, "24" should be -- 26 --

Signed and Sealed this

Eleventh Day of September, 2001

*Attest:*

Nicholas P. Godici

*Attesting Officer*

NICHOLAS P. GODICI
*Acting Director of the United States Patent and Trademark Office*